US006008587A

United States Patent [19]

Mills

[11] Patent Number: 6,008,587

[45] **Date of Patent: *Dec. 28, 1999**

[54] FLUORESCENT LAMP ELECTRONIC BALLAST CONTROL CIRCUIT

[76] Inventor: Robert Mills, 1414-29th. St. East, North Vancouver, British Columbia V7J 1T1, Canada

[ * ] Notice: This patent issued on a continued prosecution application filed under 37 CFR 1.53(d), and is subject to the twenty year patent term provisions of 35 U.S.C. 154(a)(2).

[21] Appl. No.: 08/609,032

[22] Filed: Feb. 29, 1996

[51] Int. Cl.[6] ..... H05B 41/18; H05B 41/00

[52] U.S. Cl. ..... 315/102; 315/360; 315/107; 315/205

[58] Field of Search ..... 315/101, 102, 315/106, 360, 107, 205

[56] References Cited

U.S. PATENT DOCUMENTS

| | | | |
|---|---|---|---|
| 4,215,292 | 7/1980 | Inui et al. | 315/98 |
| 4,253,043 | 2/1981 | Chermin et al. | 315/105 |
| 4,746,841 | 5/1988 | Ogawa | 315/102 |
| 4,949,015 | 8/1990 | Nilssen | 315/200 R |
| 4,988,920 | 1/1991 | Hoeksma | 315/101 |
| 5,444,333 | 8/1995 | Lau | 315/94 |
| 5,483,125 | 1/1996 | Kachmarik et al. | 315/106 |
| 5,583,399 | 12/1996 | Rudolph | 315/291 |

*Primary Examiner*—Arnold Kinkead
*Attorney, Agent, or Firm*—Oyen Wiggs Green & Mutala

[57] ABSTRACT

An electronic ballast control apparatus and method for fluorescent lamps includes applying a heating current through the filaments of the lamp, and delaying the application of arc current through the filaments and the gas for a predetermined time. This allows the filaments to heat up to a level capable of sustaining thermionic emission, thereby eliminating sputtering damage upon the application of the arc current.

9 Claims, 3 Drawing Sheets

FLUORESCENT LAMP ELECTRONIC BALLAST CONTROL CIRCUIT

TECHNICAL FIELD

This invention relates to a control circuit for use in electronic ballast for fluorescent lamps and in particular, a control circuit and method for eliminating the sputtering damage which normally occurs in such lamps during turn on.

BACKGROUND

The number of times a fluorescent lamp is turned on is known to limit the lamp's operating life. This is due to damage to the lamp electrodes which occurs during the start interval with known forms of electrical and electronic ballast used to start conventional lamps. Existing ballasts will typically start a fluorescent lamp between 10,000 and 100,000 times before the lamp becomes effectively inoperable.

A conventional rapid start fluorescent lamp is turned on by applying low voltage (typically about 3.5V) across each of the two filaments or electrodes in the fluorescent lamp tube, while simultaneously applying about 300–400V between the two electrodes. Each electrode acts alternately as an anode and as a cathode. Initially, essentially no current flows through the lamp and the 300–400V applied between the electrodes is manifested as a voltage drop between the electrodes and the gas which surrounds them. Once the electrodes are heated to a sufficient temperature, thermionic emission of electrons from the electrodes begins. The thermionic emission into the gas enclosed by the fluorescent lamp tube allows current to flow between the electrodes thereby ionizing the gas within the tube. As thermionic emission continues, current through the gas increases. When each electrode is warmed up to its operating temperature and the thermionic emission has reached a sufficiently high level, the potential difference between the gas and the electrode drops to a much lower number, in the range of 3 to 4 volts. Electronic ballast is typically provided between the power supply source and the electrode to limit the increase in current in the circuit as the gas becomes increasingly ionized. In its crudest form, such ballast may constitute a simple resistor. In such case, as thermionic emission increases the current flow through the fluorescent tube between the electrodes, the current through the resistor also increases thereby increasing the voltage drop across the resistor. This operation stabilizes when most of the voltage drop from the power supply is applied across the resistor and a relatively small voltage drop is presented between the electrodes. Usually the resistor is replaced with an inductive reactor ballast having substantially the same overall effect.

Inui et al., U.S. Pat. No. 4,215,292 discloses a circuit for operating a discharge lamp. The apparatus provides a reduced arc current during a pre-heating period. The Inui et al. device reduces but does not eliminate wear on discharge lamps. Kachmarik et al., U.S. Pat. No. 5,483,125 and Chermin et al., U.S. Pat. No. 4,253,043 provides other ballast circuits which provide a reduced arc voltage during a pre-heating interval. The pre-heating interval in each case is determined by a PTC resistor. Significant voltages can be applied between the electrodes of the Kachmarik et al. and Chermin et al. lamps even during the pre-heating interval. This is especially true if the lamps are switched off and on again while the PTC resistor is hot.

Rudolph, U.S. Pat. No. 5,583,399 shows a ballast for a fluorescent lamp in which arc voltage is reduced until after the filaments in a connected lamp become hot. The filaments are then disconnected. Disconnecting the filaments allows a resonant circuit to produce high voltage to fire the lamp. The Rudolph design does not provide continuous heater current. Lau, U.S. Pat. No. 5,444,333, shows another ballast circuit in which the heater current is off during normal operation.

Hoeksma, U.S. Pat. No. 4,988,920 discloses a power circuit for a lamp in which arc current is supplied by the secondary winding of a transformer. The arc current is disconnected until after filaments in a connected lamp are warmed up. The Hoeksma circuit appears to be primarily intended for use in devices such as photocopiers and the like. Hoeksma does not include a timer for delaying the application of arc current for a predetermined time period.

Nilssen, U.S. Pat. No. 4,949,015 shows a bridge inverter ballast which has first and second pairs of switching transistors connected to self-oscillate. When the second pair of transistors self-oscillate they generate voltage to power the main arc current in a lamp. Self oscillation of the first pair of transistors powers thermionic cathodes in a lamp. Self oscillation of the second pair of transistors is delayed until the cathodes have heated up. While the cathodes are heating up and the second set of switching transistors is not self-oscillating significant transient potentials may be applied between the lamp cathodes. Such potentials will be caused by resonances, reflections and standing waves excited by the fast square waves which are omnipresent in this design.

Damage to the electrodes occurs when they are acting as cathodes at the early stage of warm up of the electrodes when high voltage is applied to the circuit. At that stage, there is a high potential difference between each electrode and the gas surrounding it. Although the initial application of high voltage to the electrodes is brief (usually in the order of 0.2 seconds), it nonetheless causes the field emission of electrons from the electrode creating a localized plasma. Any positive ions that may be present in the area when the electrode is acting as a cathode are accelerated by the voltage drop and crash violently into the electrode thus causing damage known as sputtering damage.

In a prior art approach used in association with line voltage power sources and know as "preheat" lamps, a switch is placed in the series connection between the two electrodes and an inductor is placed in series connection between the power source and one of the electrodes. The switch is manually depressed for a period of time before being released. During the depressed or closed period, the current flows through the electrodes thereby heating them up. When the switch is released, the collapse of the magnetic field in the inductor induces a very high voltage between the two electrodes ionizing the gas in the lamp and initiating the arc discharge that characterizes normal operation. A current is then established through the gas, following which the voltage across the inductor falls to reasonable levels. A disadvantage of this approach is arcing which occurs across the switch. In such a system, sputtering damage occurs due to the high voltage drop between the electrodes which occurs during the noisy, arcing period of the closing of the manual switch, during which time the electrodes are still cold.

It is therefore an object of the invention to provide a fluorescent lamp start up control circuit which minimizes sputtering damage to the electrodes and thereby increases the number of turn ons to which the lamp may be subjected.

SUMMARY OF INVENTION

The invention comprises a turn on control circuit for a fluorescent lamp having a fluorescent lamp having a gas that can be ionized, at least two electrodes in contact with a gas and a voltage source. The circuit comprises a heater current driver for applying a heating current through each of the electrodes, an arc current driver for applying an arc current in a current path including a series path from one electrode through the fluorescing gas to another electrode, and a delay circuit for delaying the application of the arc current in said current path for a predetermined time.

In another aspect the invention comprises a circuit for turning on the fluorescent lamp having a heater current driver, first circuit means associated with said heater current driver for applying a heating current through each of two electrodes, an arc current driver, an arc current circuit for applying an arc current in a current path including a series path from one electrode through the fluorescing gas to another electrode, and a delay circuit for delaying the application of the arc current in said current path for a predetermined time. The predetermined time is such that heating current is allowed to heat the electrodes to a level capable of sustaining sufficient thermionic emission to reduce the cathode fall voltage to less than 4 volts before the arc current is applied between the electrodes.

DETAILED DESCRIPTION OF THE PREFERRED EMBODIMENT

The invention may be more fully appreciated by reference to the following detailed description of the preferred embodiment and of the best mode of putting the invention into practice, in conjunction with the drawings thereof in which.

Figure 1:
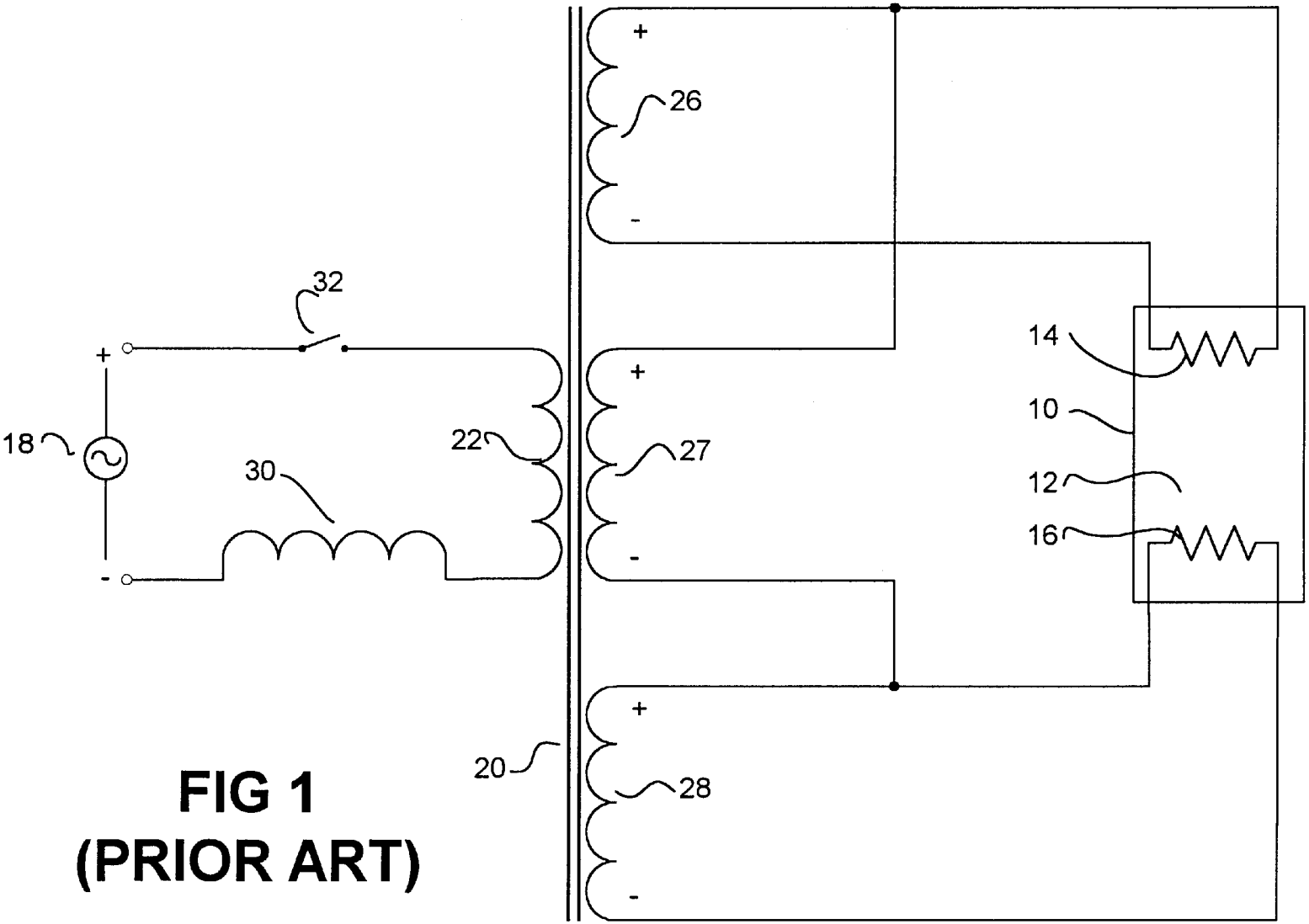
FIG 1 (PRIOR ART)
FIG. 1 is a schematic of a prior art rapid start fluorescent lamp turn on circuit.

Referring first to the prior art approach of FIG. 1, there is shown a fluorescing gas enclosure 10, two electrodes 14 and 16, a power source 18, a leakage transformer 20 having a primary winding 22, a secondary winding 24, and a third winding 26 and a fourth winding 28. Gas 12 which is capable of being ionized is contained in enclosure 10.

The reactance 30 represents the equivalent series reactance of the leakage transformer 20. The terminals of the third winding 6 are connected to the terminals of electrode 14, while the terminals of the fourth winding 28 are connected to the terminals of electrode 16. The terminals of the secondary 24 are connected to electrodes 14 and 16 respectively. The power source 18 typically generates about 300 to 400 V-AC which voltage is applied to the primary winding 22 at turn on effected by closing switch 32. The third and fourth windings are typically wound so that when switch 32 is initially closed, the voltage drop across each winding is about 3.5V. This voltage drop is applied across each of the electrodes 14 and 16. This voltage drop induces a current which begins to heat up the electrodes.

At turn on, a substantial portion of the source voltage of 300 to 400 V is applied by the secondary 24 between the electrodes 14 and 16. This high voltage induces a current in the gas. As the gas becomes increasingly ionized, the impedance of the gas decreases thereby increasing the current through the gas as well as through reactance 30. This results in a reduction of the voltage drop across the primary winding 22. The operation of the circuit stabilizes at a lower voltage drop across primary winding 22 of about 40 V and lower current through the gas.

In the circuit of FIG. 1, sputtering damage occurs during the turn on period when the current between the electrodes through the gas is just being established at which time a relatively high voltage differential (the "cathode fall" voltage) exists between each of the electrodes and the ions in the gas surrounding the electrodes. This causes the crashing of the ions into the electrodes. Eventually, the electrodes will be heated to a sufficient temperature to sustain thermionic emission at a level which reduces the cathode fall voltage thereby limiting the sputtering damage to the turn on period.

Figure 2:
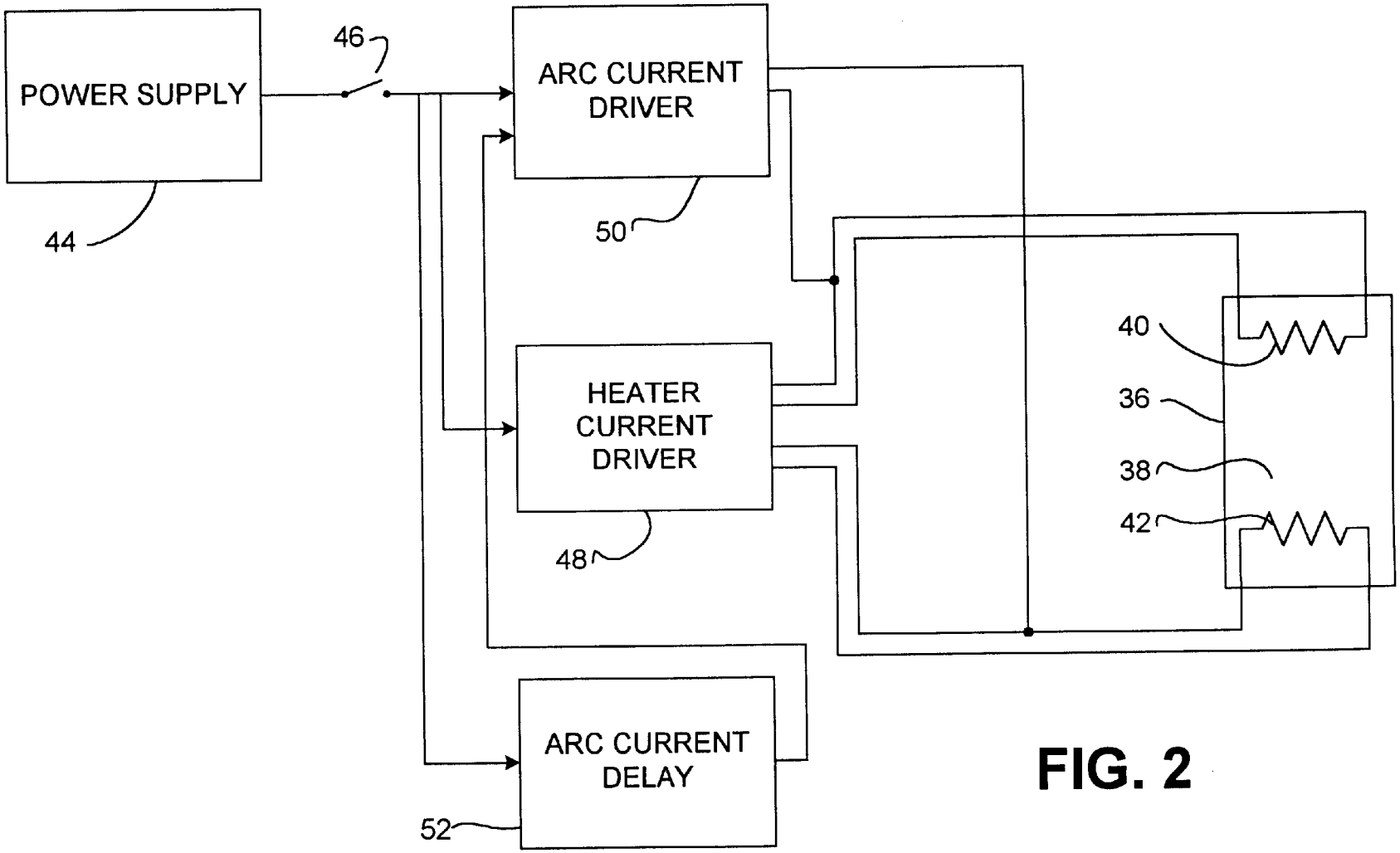
FIG. 2 is a block diagram of the circuit elements comprising the invention; and, FIG. 3 is a circuit diagram of the preferred embodiment of the invention.

FIG. 2 is a block diagram illustrating the principal components according to the invention. A gas enclosure 36 encloses a gas 38. Electrodes 40 and 42 are provided within the enclosure 36. A power supply 44 supplies power to the circuit at turn on actuated by switch 46. A heater current driver circuit 48 is provided to drive current through each of the electrodes 40 and 42. An arc current driver 50 is provided to drive current between the two electrodes 40 and 42. An arc current delay circuit 52 is provided for delaying the application of the arc current between the electrodes.

When the switch 46 is closed thereby commencing the turn on of the lamp, power is supplied to the arc current driver 50, the heater current driver 48 and the arc current delay circuit 52. The heater current driver acts to drive a current through each of the electrodes 40 and 42 thereby heating them up. The arc current delay circuit 52 includes a timing circuit for applying a pre-determined time delay before enabling the arc current driver circuit 50 to drive arc current between the electrodes 40 and 42. The predetermined delay enables the current from the heater current driver 48 to cause the electrodes 40 and 42 to heat to a sufficient level to provide the thermionic emission and a cathode fall voltage of approximately 3.5V, before applying the arc current between the electrodes. This significantly reduces the sputtering damage that would occur to the electrodes if the arc current were applied simultaneously with the heater current, as is the case in the prior art circuit of FIG. 1.

Figure 3:
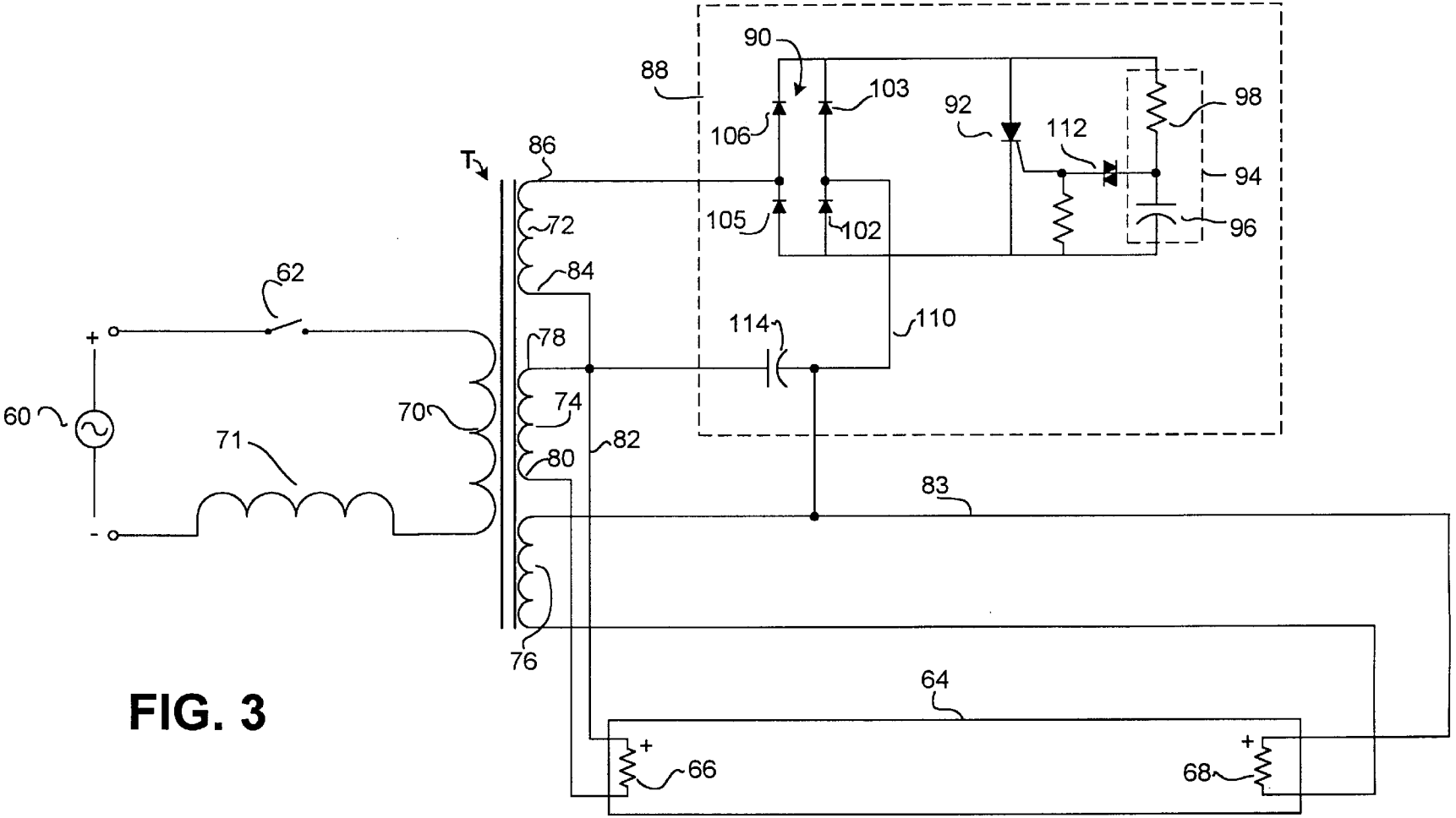

Referring now to FIG. 3, there is illustrated an input voltage source 60, in this case 110 V AC. A switch 62 is provided for applying the source voltage to the fluorescent lamp circuit. Fluorescing gas such as neon is enclosed in enclosure 64 which also encloses each of two electrodes 66 and 68. A transformer T, which may be a leakage transformer, includes a primary winding 70, a secondary winding 72, a tertiary winding 74 and a fourth winding 76. Reactance 71 represents the equivalent series reactance of the leakage transformer.

The tertiary winding terminals 78, 80 are each connected to one end of one of the electrodes 66 so as to form a closed current path 82 through electrode 66 for applying a heating current through the electrode. A similar arrangement is used for the fourth winding 76 and electrode 68 where the current path is designated by the numeral 83, and winding 76 acts as a heater current driver.

One of the terminals 84 of the secondary winding 72 is connected to electrode 66. The other terminal 86 of the secondary winding is connected to a delay circuit 88 which is in turn connected to one terminal of electrode 68. The delay circuit 88 includes a diode bridge 90 used to rectify the AC output at terminal 86 for presentation across a silicon controlled rectifier ("SCR") 92. Winding 72 acts as an arc current driver for applying arc current between the electrodes 66, 68 through an arc current path including the electrodes themselves, the gas in the enclosure, and the associated wiring.

A timing circuit 94 applies a delay determined by the time constant resulting from the values of capacitor 96 and resistor 98. Once the pre-determined time has expired, voltage is applied to the gate of SCR 92 thereby causing it to conduct. Once SCR 92 begins conducting, the current flows through diode 102 and to electrode 68. Those skilled in the art will appreciate that the diode bridge 90 acts to rectify the AC output of terminal 86 of secondary winding 72 so that a reverse voltage is avoided on SCR 92. Bilateral trigger 112 is a device which only conducts at a certain voltage. Once the SCR 92 is on, it cannot be turned off using only the gate voltage and is only turned off by a cessation of the current through the SCR. In the preferred embodiment capacitor 96 is a 0.47 $\mu$F capacitor and resistor 98 is a 2.2 megohm resistor yielding a time constant of about 1 second. This is sufficient to allow the electrodes to heat up to a level of thermionic emission sufficient to lower the cathode fall voltage to about 3.5V. This takes about 0.7 seconds in the circuit of the preferred embodiment.

The magnitude of the pre-determined time delay established by timing circuit 94 will depend in each application on the associated circuit parameters. In circumstances where the circuit parameters might change, it is within the scope of the invention to provide an adjustable time delay through the use of adjustable components in timing circuit 94. Such components might be varistors, potentiometers, or their electronically controlled equivalents.

An alternating current is generated between the terminals of secondary winding 72. During the positive cycle of the current, a positive voltage at terminal 86 is impressed across resistor 98. Any current flowing through resistor 98 is drawn through diode bridge 90. At turn on, capacitor 96 is effectively in a discharged state and therefore acts as a short circuit in the early stages of the turn on period. Capacitor 96 is charged by current supplied through connections 86 and 110, through diode bridge 90 and through resistor 98. As most of the voltage drop across secondary 72 is applied across resistor 98, there is relatively little voltage presented through connection 110 to electrode 68. Shunt capacitor 114 is connected between electrodes 66 and 68. The shunt capacitor 114 has a relatively low impedance and acts as an effective short circuit in the early stages of turn on. Shunt capacitor 114 may be called a "shunt device". It can be appreciated that during this turn on stage, shunt capacitor 114 prevents significant voltages from being applied between electrodes 66 and 68.

When capacitor 96 becomes charged, bilateral trigger 112 conducts thereby turning on SCR 92. Once SCR 92 is turned on, it acts effectively as a short circuit (with a voltage drop of approximately 1V across the SCR). The impedance of resistor 98 ceases to play a role in the circuit and substantially all of the voltage presented at terminal 86 is then applied to electrode 68 through connection 110. This high voltage acts to ionize the gas in the lamp and to induce a current through it, thereby commencing normal operation of the lamp.

As will be appreciated, circuit 88 consisting of the diode bridge 90, the timing circuit 94, the SCR 92 and associated components and the shunt capacitor 114, act jointly as a timed switch or delay circuit to apply substantially all of the voltage across the secondary between the two electrodes. The delay provides sufficient time for electrodes 66 and 68 to be heated up to a level of thermionic emission sufficient to establish a cathode fall voltage of about 3.5V, at which sputtering damage does not occur, before the arc current is applied between the electrodes.

It will of course be appreciated by those skilled in the art that certain variations may be practised to the preferred embodiment without departing from the principles of the invention.

What is claimed is:

1. A circuit for controlling a fluorescent lamp, the lamp comprising an ionizable gas, and first and second electrodes in contact with the gas, the circuit comprising:

(a) a heater current driver for applying a heater current through each of the electrodes, the heater current sufficient to heat each of the electrodes to an operating temperature at which there is sufficient thermionic emission from the respective electrode to maintain a cathode fall voltage of less than 4 volts at the electrode, the heater current driver applying the heater current during the entire period while the lamp is on;

(b) a timer circuit for measuring a predetermined preheating period which is sufficiently long for the heater current to heat both of the electrodes from an unheated condition to the operating temperature;

(c) an arc current driver for applying a potential difference between the electrodes, the potential difference being of a magnitude which is sufficient, when the electrodes are heated to the operating temperature, to initiate an arc current flowing in a current path through the gas between the electrodes and to maintain the arc current; and, (d) a switching circuit connected to the arc current driver and controlled by the timer circuit, during the preheating period the switching circuit positively preventing the arc current driver from applying a potential difference between the electrodes sufficient to generate a cathode fall voltage of 4 volts or more at either electrode wherein the switching circuit comprises a switching device connected in series between the arc current driver and the first electrode and a shunt device connected between the first and second electrodes in parallel with the current path.

2. The circuit of claim 1 wherein the switching device comprises a silicon controlled rectifier.

3. The circuit of claim 1 wherein the shunt device comprises a capacitor.

4. The circuit of claim 3 wherein the switching device comprises a silicon controlled rectifier.

5. The circuit of claim 4 wherein the arc current driver comprises a transformer having a secondary winding, one side of the secondary winding is electrically connected to the first electrode, a second side of the secondary is electrically connected to one input of a diode bridge, a second input of the diode bridge is electrically connected to the second electrode and the silicon controlled rectifier is electrically connected in parallel between positive and negative outputs of the diode bridge wherein, when the silicon controlled rectifier is turned on, current can flow from the second side of the secondary, through the diode bridge and through the silicon controlled rectifier to the second electrode.

6. The circuit of claim 5 wherein the timer circuit comprises a timing capacitor connected in series with a timing resistor, the timing capacitor and timing resistor connected in parallel with the silicon controlled rectifier, and the silicon controlled rectifier has a gate electrode electrically coupled to a junction between the timing resistor and the timing capacitor.

7. The circuit of claim 6 wherein the gate electrode is coupled to the junction by way of a bilateral trigger device.

8. A method for operating a fluorescent lamp, the fluorescent lamp comprising an ionizable gas, and first and second electrodes in contact with the gas, the method comprising:

a) applying a heating current through each of the first and second electrodes;

b) electronically measuring a pre-heating time sufficient for the heating current to heat the electrodes to an operating temperature at which there is sufficient thermionic emission from each of the electrodes to maintain a cathode fall voltage of less than 4 volts at each of the electrodes when arc current passes between the electrodes;

c) during the pre-heating time ensuring that a potential difference between the electrodes is maintained at a value of less than 4 volts;

d) after the pre-heating time, applying a potential difference between the electrodes of a magnitude sufficient to initiate an arc current flowing in a current path through the gas between the electrodes and to maintain the arc current; and, e) maintaining the heater current for the entire time that the lamp is turned on wherein applying a potential difference between the electrodes comprises closing a switching device connected in series with the electrodes in an electrical circuit extending between two terminals of an arc current driver and ensuring that a potential difference between the electrodes is maintained at a value of less than 4 volts during the pre-heating time comprises maintaining the switching device in an open circuit condition and providing a shunt device connected between the electrodes in parallel with the current path.

9. The method of claim 8 wherein the shunt device comprises a capacitor.

* * * * *